United States Patent [19]

Codina

[11] Patent Number: 4,653,697

[45] Date of Patent: Mar. 31, 1987

[54] METHOD AND APPARATUS FOR FRAGMENTING A SUBSTANCE BY THE DISCHARGE OF PULSED ELECTRICAL ENERGY

[75] Inventor: George Codina, Hartsdale, N.Y.

[73] Assignee: CEEE Corporation, Stamford, Conn.

[21] Appl. No.: 730,183

[22] Filed: May 3, 1985

[51] Int. Cl.[4] ..... B02C 19/18

[52] U.S. Cl. ..... 241/1; 241/301

[58] Field of Search ..... 166/248, 250, 271, 308, 166/65 R, 66, 177; 241/1, 14, 301

[56] References Cited

U.S. PATENT DOCUMENTS

| | | |
|---|---|---|
| 1,719,257 | 7/1929 | Booth et al. . |
| 2,132,807 | 10/1938 | Rust, Jr. et al. . |
| 2,156,259 | 5/1939 | Blau . |
| 2,183,565 | 12/1939 | Hawley . |
| 2,795,279 | 6/1957 | Sarapuu . |
| 2,799,641 | 7/1957 | Bell . |
| 3,103,975 | 9/1963 | Hanson . |
| 3,106,244 | 10/1963 | Parker . |
| 3,169,577 | 2/1965 | Sarapuu . |
| 3,208,674 | 9/1965 | Bailey . |
| 3,211,220 | 10/1965 | Sarapuu . |
| 3,236,304 | 2/1966 | Sarapuu . |
| 3,460,766 | 8/1969 | Sarapuu . |
| 4,046,194 | 9/1977 | Cloud . |
| 4,084,638 | 4/1978 | Whiting . |
| 4,135,579 | 1/1979 | Rowland et al. . |
| 4,140,179 | 2/1979 | Kasevich et al. . |
| 4,313,573 | 2/1982 | Goldberger et al. . |
| 4,373,581 | 2/1983 | Toellner . |
| 4,540,127 | 9/1985 | Andres ..... 241/1 |

FOREIGN PATENT DOCUMENTS 827784 5/1981 U.S.S.R. .

OTHER PUBLICATIONS

Sarapuu, Erich; "Electro-Energetic Rock Breaking Systems"; Mining Congress Journal; Jun. 1973; pp. 44–54.

Kravchenko, V. S. et al; "Dustless Breaking of Rocks Electrically"; Mining Congress Journal: May 1961; pp. 53–55.

Tunnel and Tunnelling, pp. 427 & 428 of Sep.-Oct. issue-1972.

*Primary Examiner*—Mark Rosenbaum .

*Attorney, Agent, or Firm*—Bacon & Thomas

[57] ABSTRACT

A method and apparatus for fragmenting a substance by discharging pulsed electrical energy through the substance is disclosed wherein electrodes are placed in contact with the substance and a series of measuring pulses are discharged into the substance to determine the characteristic pulse and the characteristic impedance of the substance. Based upon the series of measuring pulses at least one fragmenting pulse is discharged into the substance through the electrodes to cause the substance to fragment.

37 Claims, 8 Drawing Figures

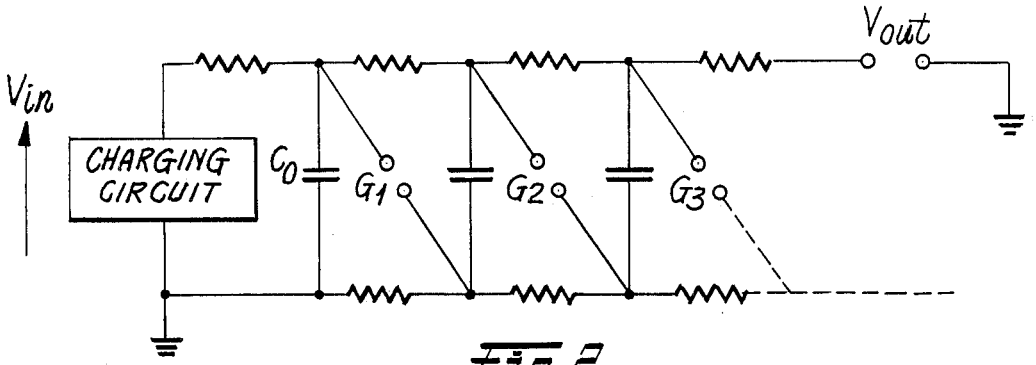
Fig. 2
Fig. 3
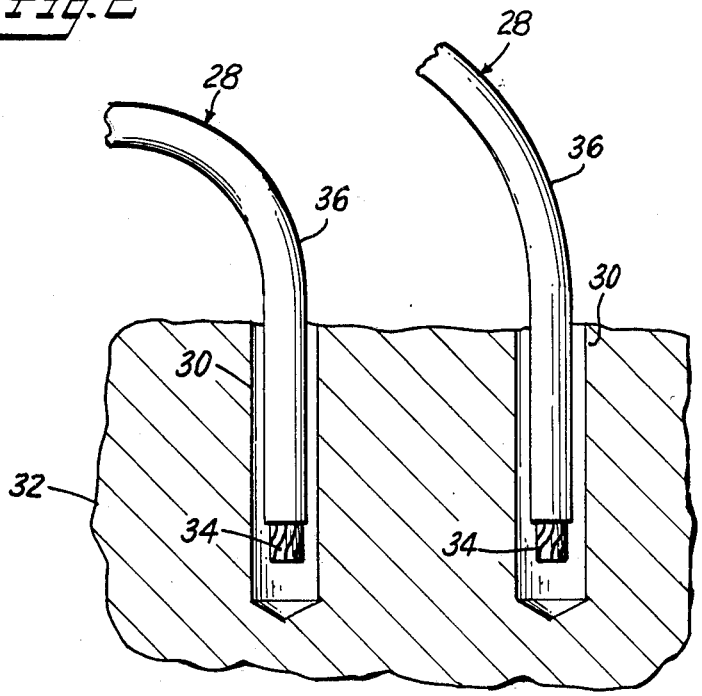
Fig. 4
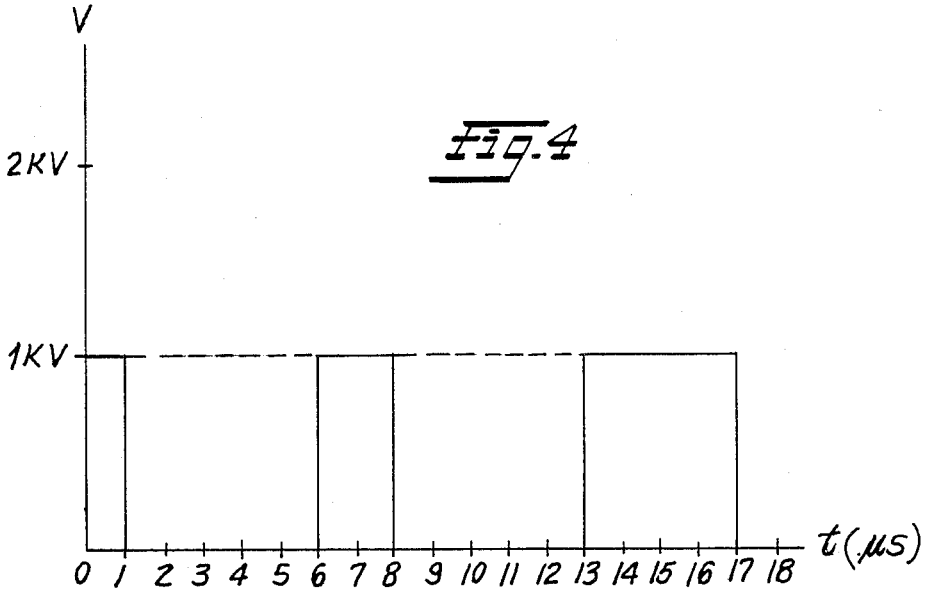

METHOD AND APPARATUS FOR FRAGMENTING A SUBSTANCE BY THE DISCHARGE OF PULSED ELECTRICAL ENERGY

This application is related to U.S. Ser. No. 728,612 filed on Apr. 29, 1985, which is a continuation of Ser. No. 572,522 filed on Jan. 20, 1984.

BACKGROUND OF THE INVENTION

1. Field of the Invention

The instant invention relates to a method and an apparatus for fragmenting a substance by discharging pulsed electrical energy through the substance. More specifically, the pulsed electrical energy is discharged through the substance via a plurality of electrodes located in the substance.

2. Brief Description of the Prior Art

The prior art has long recognized the potential of electrical energy to break or fragment a solid substance. This potential has been particularly recognized in the field of underground mining and in the formation and production of subterranean wells. In these areas, it is often necessary to fracture a hard, solid substance, such as rock, to advance the face of the mining shaft, or to increase the production from an underground well by fracturing the surrounding subterranean area.

The earliest attempts at utilizing electrical energy to fragment rocks involved placing a plurality of resistance electrodes in holes formed in the rock and subsequently passing an electric current through the electrodes. The heating of the rock by the electrodes eventually caused it to fracture along the path of the electrodes due to thermal stresses induced in the rock. Apparatus for inducing thermal stresses in rock to advance a mine face are also known. These devices typically utilize electrode arcing to heat the rock face and cooling means to cool the face after the application of the electric arc. This cyclical heating and cooling induces thermal stresses within the rock face which subsequently cause it to fragment. The more modern devices utilize this basic technology of heating or heating/cooling steps, but use electron beams or high velocity plasma jets to accomplish the heating.

It is also known to apply electrical impulses to substances such as rocks to cause them to fracture. The electrical impulses establish an electrical current path between electrodes applied to the rock through naturally occuring lower resistance paths. The current then causes the vaporization and expansion of liquids contained within the rock, which expansion exerts internal pressure causing the rock to fracture. Alternatively, the rock may be treated with a liquid, such as an electrolyte solution, prior to the application of electrical pulses to assist in the establishment of an electrical path between the electrodes. Where the rock is not pre-treated with a liquid solution, it may be necessary to utilize multipoint electrodes in order to establish a current path between the electrodes through the rock.

Electrical pulses have also been utilized as part of a two-stage process for rock fragmentation. Electrical pulses cause numerous micro-fractures in the rock, which is subsequently caused to fragment along these fractures by the application of accoustical energy.

Electrical energy may also be used to drill into a hard substance, such as rock. The prior art is replete with various forms of spark drills which depend upon an arc between either a pair of electrodes, or an electrode and the surrounding formation itself to cause it to fracture. The electrodes may be utilized by themselves or in combination with a standard roller cone drill bit.

None of the prior art apparatus has proven to be efficient from an energy consumption standpoint. The input energy required by these devices in order to accomplish their purposes within a reasonable amount of time has proven to be economically unsound, especially in view of the constantly rising energy costs. Any device which relies upon the heating of the rock or the liquid contained in a rock, must, of necessity, have a high energy input or require energy input over a relatively long period of time.

SUMMARY OF THE INVENTION

The instant invention overcomes the inefficiency and high energy input requirements of the prior art by setting forth a method and apparatus which discharges a pulse or pulses of electrical energy through a substance, such as rock, in such a way that the substance will fracture. A series of measurement pulses, each having a common control voltage amplitude but of varying duration, are discharged into the substance to determine the optimum duration of a fragmenting pulse and to determine the characteristic impedance of the substance. One or more fragmenting pulses are then discharged into the substance. Each of the fragmenting pulses is of predetermined voltage amplitude and is discharged into the substance in an extremely short time. The extremely rapid application of one or more electrical pulses will cause the substance to fragment in an extremely short time. The method and apparatus according to the invention gives a greater output per unit of input than the prior art methods and apparatus.

The apparatus utilized to carry out the method according to the instant invention may comprise an energy storage system that may use capacitors, inductors, or a combination of both, as electrical energy storage devices; a power source and current regulator to charge the energy storage device to a predetermined level; a pulse generator to accurately shape and apply the measuring pulses; and a plurality of electrodes connected to the capacitor bank or the pulse generator through switching means to apply the electrical energy directly to the substance. The electrodes may be placed within holes formed in the substance and be insulated such that only their extremities are exposed. Transmission lines interconnecting the energy storage bank, the pulse generator and the electrodes must not degrade the time duration of the electrical pulse, nor alter its wave shape.

BRIEF DESCRIPTION OF THE DRAWINGS

FIG. 2 is a schematic diagram of a capacitor bank used with the device in FIG. 1.

FIG. 3 is an enlarged view showing the electrodes of the device shown in FIG. 1.

FIG. 4 is a graph showing the voltage level versus time for the measuring pulse train according to the invention.

DETAILED DESCRIPTION OF THE PREFERRED EMBODIMENTS

Although it is believed that the method and apparatus set forth herein are capable of fragmenting a number of solid substances, they will be described in terms of their application for fracturing rocks. It is to be understood that the same principles may be applied to other solid substances.

Figures 1, 7, 8:
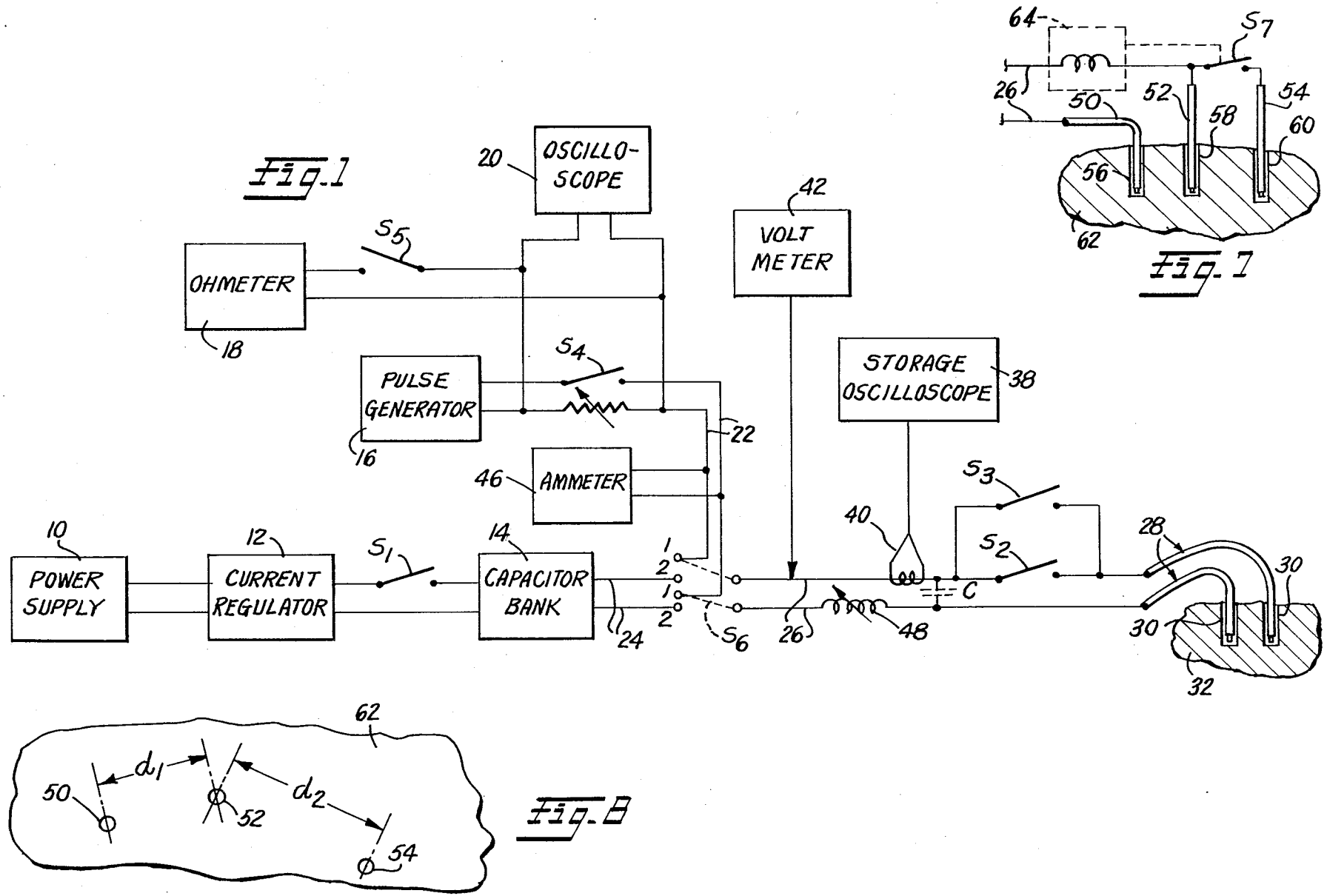
FIG. 1 is a schematic diagram of the pulsed electrical energy device according to the invention.
FIG. 7 is a partial schematic diagram showing an alternative embodiment of the invention using three electrodes.
FIG. 8 is a top view of the rock in FIG. 7 showing the relative positions of the three electrodes.

The apparatus according to the invention is schematically shown in FIG. 1 and comprises power supply 10 connected to a current regulator 12, which is, in turn, connected to energy storage bank 14. Power supply 10 may have an output of 100 watts and 120 volts A.C. while current regulator 12 may have a capacity of 5mA. Various forms of energy storage banks are known, such as capacitors, inductors, etc., and may be utilized with this invention, their size and output depending upon the type and size of the rock to be fragmented. A capacitor bank is shown in FIG. 2 wherein the capacitors, of which there may be four of 30 $\mu$ F each, are charged in parallel and subsequently discharged in series. Conduction occurs upon sequentially firing into conduction switches $G_1$, $G_2$, etc. The switches in the example are of the spark gap type. After all the switches have fired, the capacitors are connected in series. Manual charging switch $S_1$ is inserted between the current regulator 12 and the energy storage bank 14 and, when closed, connects the bank to the power supply to facilitate charging.

The apparatus also comprises pulse generator 16, capable of generating a series of variable duration, constant voltage pulses, ohmeter 18 and oscilloscope 20. Each of these elements may be of known configuration and the structures of each, per se, form no part of the instant invention. The shape and duration of the train or series of measuring pulses generated by pulse generator 16 may be visually examined on oscilloscope 20, for purposes which will be hereinafter described in more detail. Output leads 22 of pulse generator 16 are connected to one position of two-position switch $S_6$. The second position terminals of switch $S_6$ are connected to output leads 24 emanating from energy storage bank 14.

As shown, switch $S_6$ is also connected to copper bus bars 26. Bus bars 26 should be formed so as to exhibit the characteristics of a tapered transmission line in order to minimize any mis-match conditions which would degrade the shape of the pulses transmitted to the electrodes 28. When switch $S_6$ is in the first position, as shown by the dashed lines in FIG. 1, and switches $S_4$ and $S_5$ are closed, the pulse generator provides a train of measuring pulses to the bus bars 26. When switch $S_6$ is moved to the second position, capacitor bank 14 is connected to bus bars 26 through output leads 24 to deliver the fragmenting pulses.

The opposite ends of bus bars 26 are connected to electrodes 28 whose distal ends are inserted into holes 30 formed in rock 32. In this embodiment, a pair of electrodes 28 are used, one connected to each bus bar 26. Electrodes 28 may comprise stranded copper cables 34 having an insulating material 36 covering all but the distal end portions. The end portions, which may be approximately ½ inch in length, of the copper cables are exposed as shown in FIG. 3. The diameter of holes 30 is not critical, but should be, of course, large enough to accommodate the electrodes 28.

Storage oscilloscope 38 may be connected with bus bars 26 via known connections with pick-up coil 40. Pick-up coil 40 may extend around one of the bus bars 26 and may comprise a standard current probe. Volt meter 42 is also connected to bus bars 26 by known connection means.

Switch $S_2$ and bypass measuring switch $S_3$ are connected to bus bars 26 as shown in FIG. 1. Switch $S_2$ is the main switch which connects the capacitor bank to the electrodes and should be capable of conducting high voltage and high current in extremely short periods of time. It has been found that a General Electric number GL 7703 mercury switch performs satisfactorily under the conditions necessary to fragment known rocks. Switch $S_3$ is closed only during the time the measuring train of pulses are applied to the rock and, thus, it need not be capable of withstanding the same operational parameters as switch $S_2$.

In order to utilize applicant's invention, the electrodes 28 are inserted into holes 30 as shown. In order to determine the optimum fracturing pulse or pulses, the series of variable duration, constant voltage measuring pulses are initially passed through the rock 32. This is accomplished by placing switch $S_6$ in the position shown in FIG. 1, and closing switches $S_3$, $S_4$ and $S_5$, thereby connecting the pulse generator 16 to the electrodes 28. Pulse generator 16 produces a train of measuring pulses, each having a magnitude of 1 KV and varying duration. An initial pulse may have a duration of 1 $\mu$sec., a second pulse may have a duration of 2 $\mu$sec., and a third pulse may have a duration of 4 $\mu$sec. The interval between the pulses is not critical and depends primarily on the capabilities of the equipment being utilized. Although the number and duration of the pulses may be varied to suit individual materials, it has been found that the use of three pulses of the durations noted above and shown in FIG. 4 provides satisfactory results. During the application of the measuring pulse train to the rock, the current of each of the pulses into the load is measured by ammeter 46. The pulse duration having the highest current value is selected as the time duration of the fragmenting pulse to be applied to the rock. Since the current and voltage of the selected pulse duration is known, the characteristic impedance of the rock may be calculated by Ohm's Law ($Z=E/I$). The characteristic impedance value is used to set the values of adjustable inductor 48 and the distribution capacitance C, in the bus bars 26. Thus, the application of the train of measuring pulse to the rock determines the duration of the fragmenting pulse as well as the impedance of the system to be used during the application of the fragmenting pulse.

In experiments conducted on a wide variety of rocks weighting between 40 and 1200 lbs., it has been found that only a single pulse is necessary to cause a fragmentation of the rock. The application of a single pulse of high voltage electrical energy in an extremely short time period (on the order of several microseconds) causes the rock to fragment, while at the same time keeping the total energy expended to a remarkably low level. In experiments conducted thus far, the energy level has ranged from 1.5 to 7 KJ needed to fragment the rock with a single pulse.

Examples of the experimental results are as follows.

| EXAMPLE 1 | |
|---|---|
| Rock type | Silicified Sandstone |

-continued

| | |
|---|---|
| Weight | 150 lbs. |
| Electrode diameter | ¼ inch |
| Electrode separation | 2 inches |
| Electrode depth | 4 inches |
| Energy expended | 1.5 KJ |

Result: Rock was fragmented into two pieces.

EXAMPLE 2

| | |
|---|---|
| Rock type | Silicified Sandstone |
| Weight | 200 lbs. |
| Electrode diameter | ⅜ inch |
| Electrode separation | 1 inch |
| Electrode depth | 6 inches |
| Energy expended | 1.5 KJ |

Result: Rock was fragmented into nine pieces.

EXAMPLE 3

| | |
|---|---|
| Rock type | Silicified Sandstone |
| Weight | 400 lbs. |
| Electrode diameter | 11/16 inch |
| Electrode separation | 2 inches |
| Electrode depth | 6 inches |
| Energy expended | 4 KJ |

Result: Rock was fragmented into thirty-two pieces.

EXAMPLE 4

| | |
|---|---|
| Rock type | Silicified Sandstone |
| Weight | 288 lbs. |
| Electrode diameter | 11/16 inch |
| Electrode separation | 3½ inches |
| Electrode depth | 6½ inches |
| Energy expended | 5 KJ |

Result: Rock was fragmented into five pieces.

EXAMPLE 5

| | |
|---|---|
| Rock type | Sandstone |
| Weight | 274 lbs. |
| Electrode diameter | 1 inch |
| Electrode separation | 1⅞ inches |
| Electrode depth | 8 inches |
| Energy expended | 4 KJ |

Result: Rock was fragmented into five pieces.

EXAMPLE 6

| | |
|---|---|
| Rock type | Granite |
| Weight | 275.5 lbs. |
| Electrode diameter | 1 inch |
| Electrode separation | 2 inches |
| Electrode depth | 9 inches |
| Energy expended | 6 KJ |

Result: Rock was fragmented into six pieces.

It should be emphasized that the instant invention does not rely upon the heating of the rock to induce thermal stresses therein, nor does it rely upon the conversion of connate liquids into vapor to supply the fragmenting forces. If the total amount of energy utilized by this apparatus were applied to the rock over an extended period of time, it would be sufficient to raise the temperature of the rock only approximately 0.1° C. During numerous experiments, it has been found that the fragmented rock is cool to the touch immediately after fragmentation and no overt signs of heating have been observed in any of the fragments. Although the precise mechanism which causes the fragmentation of rocks is not known at this time, it is believed to relate to the application of a large amount of electrical energy within a very short period of time, thus keeping the overall energy requirement at a relatively low level.

The initial pulse or the initial portion of a single pulse is believed to lower the impedance of the rock to allow the next pulse or the remaining portion of a single pulse to fragment the rock with a lower expenditure of energy. The rise time of the fragmenting pulse should be such that between 10% and 90% of the pulse is applied in approximately 10 nanoseconds.

Figure 5:
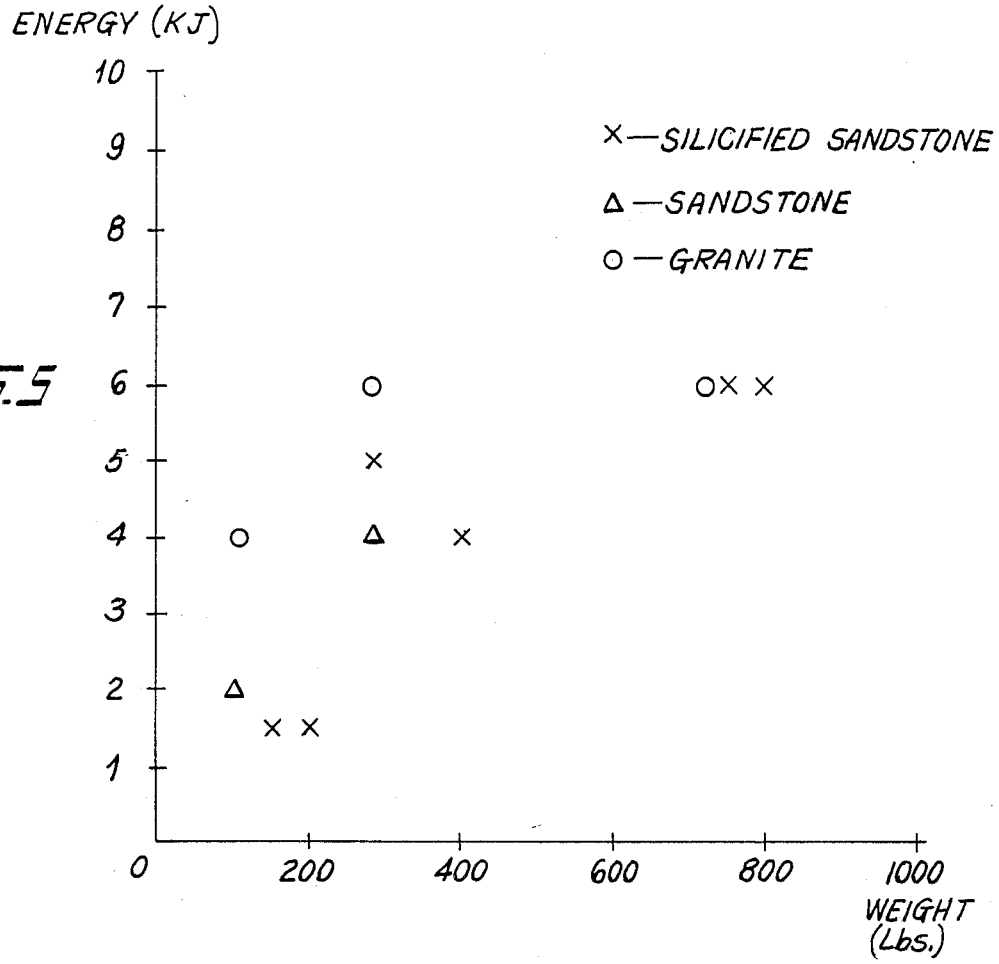
FIG. 5 is a graph showing the energy required to fragment various types and weights of rocks.

As shown in FIG. 5, the energy requirements have been found to vary according to the type and weight of the rock, although in the extreme cases observed to this point, it is less than 7 KJ even for rocks weighing as much as 800 pounds.

Figure 6:
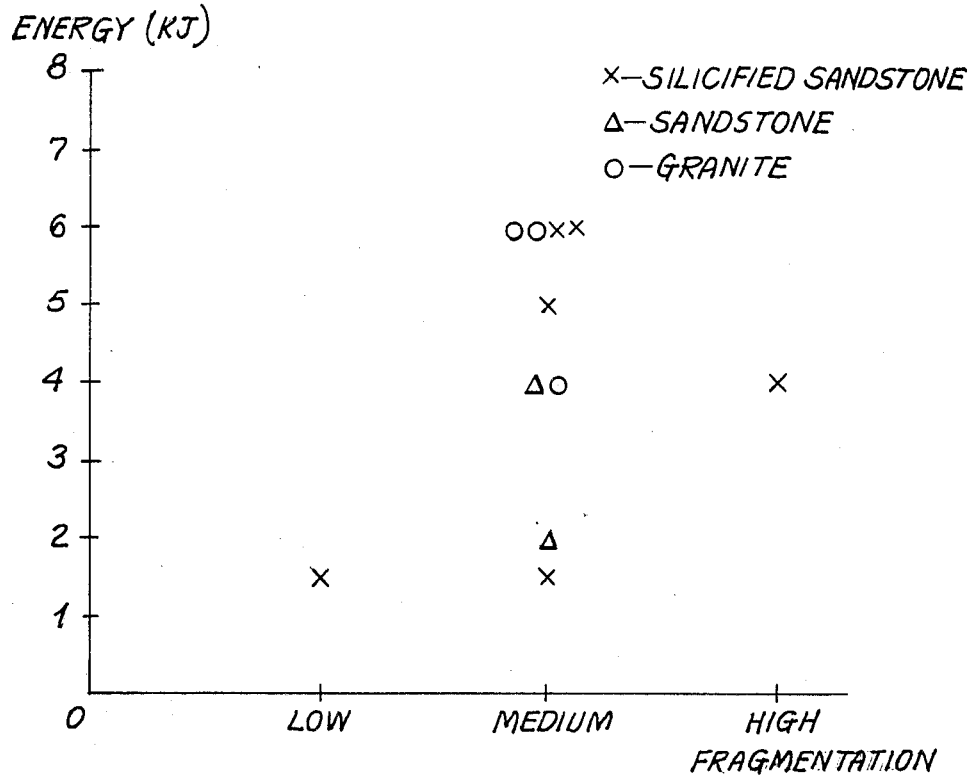
FIG. 6 is a graph showing the energy requirements to achieve various levels of fragmentation.

The amount of energy input will also control the amount of fragmentation of the rock as shown in FIG. 6. The levels of fragmentation as used in that Figure are defined as follows:

Low—the size of the pieces after fragmentation average 25% or more of the original volume;

Medium—pieces after fragmentation average between 10% and 25% of the original volume;

High—pieces after fragmentation average less than 10% of the original volume.

The instant invention has been utilized to fragment virtually all types of rocks as demonstrated by experimental results.

An alternative embodiment is shown in FIGS. 7 and 8 wherein three electrodes are inserted into the rock. In this embodiment, electrodes 50, 52 and 54 are inserted into holes 56, 58 and 60, respectively, formed in rock 62. Electrode 50 is connected to one of the bus bars 26, while electrodes 52 and 54 are connected in parallel to the other bus bar 26, all connection being made downstream from switches $S_2$ and $S_3$.

As shown in FIG. 8, the distance $d_1$ between electrodes 50 and 52 should be less than the distance $d_2$ between the electrodes 52 and 54.

Inductor 64 is connected to bus bar 26 upstream of electrodes 52 and 54, and switch $S_7$ is connected between the electrodes 52 and 54. Switch $S_7$ is normally open, but closes automatically when the voltage across inductor 64 reaches a predetermined level.

Upon closing switch $S_2$ in the normal manner, as previously described, the energy storage bank 14 will discharge through inductor 64 between electrodes 50 and 52. The discharge path through the rock will open when at or close to the peak current. Subsequently, a very high potential will develop across inductor 64. Switch $S_7$ will automatically close upon sensing this voltage $$\left(V = L\frac{di}{dt}\right)$$

releasing the stored energy in inductor 64 ($W=\frac{1}{2}LI^2$) between electrodes 52 and 54 and further fragmenting the rock between those points. Inductor 64 should have a low charging time to the power (P) supplied to inductor 64 at constant current I is determined by:

$$P=I^2(R1+Za)$$

wherein:

R1 = ohmic resistance of inductor

Za = complex impedance of rock material between electrodes 50 and 52.

The energy into the inductor is given as $W=\frac{1}{2}LI^2$, therefore, after solving for $I^2$ and substituting in the above equation:

$$P = 2W\frac{R1 + Za}{L}$$

The peak power to load Zl (the complex impedance of the rock material between electrodes 52 and 54) is $Pl=I^2 \cdot Zl$. For high energy discharge $$\frac{P1}{P} = \frac{Z1}{R1 + Za}$$

with Z1>>(R1+Za) and for high efficiency, inductor time constant t $$\left( t = \frac{L}{R1 + Za} \right)$$

must be larger than T. This would result in an extremely short charging time (capacitor charging) and a very low ohmic resistance of L. This may be achieved by operating the inductor 64 at extremely low temperatures in a cryogenic environment.

The foregoing description has been provided for illustrative purposes only and should not be construed as in any way limiting this invention, the scope of which is defined solely be the appended claims.

What is claimed is:

1. A method of fragmenting a substance by discharging pulsed electrical energy through the substance comprising the steps of:

(a) contacting the substance with a plurality of electrodes;

(b) discharging a series of measuring pulses into the substance via the electrodes, the measuring pulses having a common voltage amplitude, but different time duration;

(c) measuring the amplitude of the current passing between the electrodes for each measuring pulse;

(d) selecting the measuring pulse having the highest current amplitude as the characteristic pulse duration for fragmenting the substance; and, (e) discharging at least one fragmenting pulse having an energy level of between 0.5 and 100 KJ into the substance via the electrodes, the fragmenting pulse having a duration approximately equal to the characteristic pulse duration.

2. The method of fragmenting a substance according to claim 1 comprising the further steps of:

(a) calculating the characteristic impedance of the substance from the voltage and measured current of the characteristic pulse; and, (b) adjusting the impedance of transmission lines connecting the electrodes to a pulse source to match the characteristic impedance of the substance.

3. The method of fragmenting a substance according to claim 1 comprising the additional steps of:

(a) forming a plurality of holes in the substance; and (b) placing each of the electrodes in a hole before carrying out the steps of discharging the measuring or fragmenting pulses. the at least one fragmenting pulse.

4. The method of fragmenting a substance according to claim 3 wherein the at least one fragmenting pulse is discharged through a pair of electrodes inserted into a pair of holes formed in the substance.

5. The method of fragmenting a substance according to claim 4 wherein a single fragmenting pulse is discharged into the substance.

6. The method of fragmenting a substance according to claim 5 wherein the energy level of the fragmenting pulse is between 0.5 and 15 KJ.

7. The method of fragmenting a substance according to claim 5 wherein the distance between the electrodes through the substance is between 1 and 12 inches.

8. The method of fragmenting a substance according to claim 4 wherein a pair of fragmenting pulses are sequentially discharged into the substance.

9. The method of fragmenting a substance according to claim 8 wherein the energy levels of the fragmenting pulses are between 0.5 and 15 KJ.

10. The method of fragmenting a substance according to claim 8 wherein the distance between the electrodes through the substance is between 1 and 12 inches.

11. The method of fragmenting a substance according to claim 3 wherein the at least one fragmenting pulse is discharged through three electrodes inserted into the substance.

12. The method of fragmenting a substance according to claim 11 comprising the additional steps of connecting the second and third electrodes in parallel and locating the three electrodes such that the distance between the first and second electrodes is smaller than the distance between the second and third electrodes.

13. The method of fragmenting a substance according to claim 12 comprising the additional steps of:

(a) connecting the second and third electrodes to a common transmission line;

(b) placing an inductor in the transmission line upstream of the second and third electrodes; and, (c) placing an automatic switch between the first and second electrodes such that, when the voltage across the inductor reaches a predetermined level, the switch is triggered to release the energy stored in the inductor between the second and third electrodes.

14. The method of fragmenting a substance according to claim 13 wherein the inductor is located in a cryogenic environment.

15. The method of fragmenting a substance according to claim 1 wherein the measuring pulses have a voltage amplitude of approximately 1 KV.

16. The method of fragmenting a substance according to claim 1 comprising the additional step of charging an energy storage bank connected to the electrodes to a predetermined level prior to discharging the at least one fragmenting pulse.

17. The method of fragmenting a substance according to claim 1 wherein three measuring pulses are discharged into the substance.

18. The method of fragmenting a substance according to claim 17 wherein the measuring pulses have a voltage amplitude of approximately 1 KV.

19. The method of fragmenting a substance according to claim 18 wherein the duration of the measuring pulses are approximately 1 μsec., 2 μsec., and 4 μsec., respectively.

20. The method of fragmenting a substance according to claim 1 wherein 10% and 90% of the at least one fragmenting pulse is applied to the substance in less than 50 nanoseconds ($50\times10^{-9}$ sec.).

21. The method of fragmenting a substance according to claim 20 wherein between 10% and 90% of the at least one fragmenting pulse is applied to the substance in approximately 10 nanoseconds ($10\times10^{-9}$ sec.).

22. Apparatus for fragmenting a substance by discharging pulsed electrical energy through the substance comprising:

(a) a plurality of electrodes adapted to be placed in contact with the substance;

(b) means to generate a first series of measuring pulses, the measuring pulses having a common voltage amplitude, but different time duration;

(c) means to measure the amplitude of the current passing between the electrodes for each measuring pulse;

(d) means to generate at least one fragmenting pulse having an energy level of between 0.5 and 100 KJ and a time duration approximately equal to the time duration of the measuring pulse having the largest current amplitude; and (e) electrical transmission lines having switch means therein for connecting the plurality of electrodes with the means to generate the measuring pulses or the means to generate the at least one fragmenting pulse.

23. The apparatus according to claim 22 further comprising means to adjust the impedance of the electrical transmission lines to match the characteristic impedance of the substance as determined from the voltage and current of the measuring pulse having the largest current amplitude.

24. The apparatus according to claim 22 wherein the means to generate at least one fragmenting pulse comprises an energy storage bank.

25. The apparatus according to claim 24 wherein the energy storage bank comprises a bank of capacitors.

26. The apparatus according to claim 22 wherein the measuring pulses each have a voltage amplitude of at least 1 KV.

27. The apparatus according to claim 26 wherein the means to generate the measuring pulses generates three such measuring pulses.

28. The apparatus according to claim 27 wherein the time duration of the measuring pulses are approximately 1 μsec., 2 μsec., and 4 μsec., respectively.

29. The apparatus according to claim 22 wherein the plurality of electrodes comprise a pair of electrodes contacting the substance.

30. The apparatus according to claim 22 wherein the means to generate at least one fragmenting pulse generates a single fragmenting pulse.

31. The apparatus according to claim 22 wherein the means to generate at least one fragmenting pulse generates two fragmenting pulses which are sequentially applied to the substance through the electrodes.

32. The apparatus according to claim 22 wherein the plurality of electrodes comprise first, second and third electrodes contacting the substance.

33. The apparatus according to claim 32 further comprising means connecting the second and third electrodes in parallel to the same electrical transmission line.

34. The apparatus according to claim 33 wherein the distance between the first and second electrodes is smaller than the distance between the second and third electrodes.

35. The apparatus according to claim 34 further comprising:

(a) an inductor located in the electrical transmission line upstream of the second and third electrodes; and (b) automatic switch means located in the electrical transmission line between the second and third electrodes such that, when the voltage across the inductor reaches a predetermined level, the switch means closes to release the energy stored in the inductor between the second and third electrodes.

36. The apparatus according to claim 22 wherein the means to generate at least one fragmenting pulse applies between 10% and 90% of the at least one fragmenting pulse to the substance in less than 50 nanoseconds ($50\times10^{-9}$ sec.).

37. The apparatus according to claim 36 wherein the means to generate at least one fragmenting pulse applies between 10% and 90% of the at least one fragmenting pulse to the substance in approximately 10 nanoseconds ($10\times10^{-9}$ sec.).

* * * * *